US010030477B2

(12) United States Patent
Hornsby

(10) Patent No.: US 10,030,477 B2
(45) Date of Patent: Jul. 24, 2018

(54) SHIFTING SLEEVES WITH MECHANICAL LOCKOUT FEATURES

(71) Applicant: HALLIBURTON ENERGY SERVICES, INC., Houston, TX (US)

(72) Inventor: Joshua Max Hornsby, Keller, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 192 days.

(21) Appl. No.: 14/410,733

(22) PCT Filed: Jan. 30, 2014

(86) PCT No.: PCT/US2014/013741
§ 371 (c)(1),
(2) Date: Dec. 23, 2014

(87) PCT Pub. No.: WO2015/116081
PCT Pub. Date: Aug. 6, 2015

(65) Prior Publication Data

US 2016/0258251 A1 Sep. 8, 2016

(51) Int. Cl.
*E21B 34/12* (2006.01)
*E21B 34/14* (2006.01)
*E21B 34/00* (2006.01)

(52) U.S. Cl.
CPC ..... *E21B 34/12* (2013.01); *E21B 34/14* (2013.01); *E21B 2034/007* (2013.01)

(58) Field of Classification Search
CPC .... E21B 34/12; E21B 34/14; E21B 2034/007; E21B 34/06
See application file for complete search history.

(56) References Cited

U.S. PATENT DOCUMENTS 3,672,193 A * 6/1972 Schiller ..... H01R 43/0427 72/31.01
5,730,224 A * 3/1998 Williamson ..... E21B 23/002 166/117.6
7,686,342 B2 * 3/2010 Jennings ..... E21B 17/085 285/323
8,800,655 B1 * 8/2014 Bailey ..... E21B 33/146 166/177.4
2005/0199399 A1 9/2005 Hayter et al.
2009/0139726 A1 6/2009 Gomez
2011/0114325 A1 * 5/2011 Coghill ..... E21B 23/00 166/332.3

(Continued)

OTHER PUBLICATIONS

International Patent Application No. PCT/US2014/013741 , International Search Report and Written Opinion, dated Oct. 24, 2014, 12 pages.

*Primary Examiner* — Taras P Bemko
*Assistant Examiner* — Manuel C Portocarrero
(74) *Attorney, Agent, or Firm* — Kilpatrick Townsend & Stockton LLP

(57) ABSTRACT

Certain aspects are directed to devices designed to lock shifting sleeves. In a particular aspect, there is provided a shifting sleeve with a mechanical lockout feature, comprising: a shifting sleeve comprising a shifting profile and a locking feature; a housing comprising a corresponding locking feature, wherein application of pressure or torque or both to the shifting profile of the shifting sleeve causes movement of the shifting sleeve and a mechanical lock with the housing.

18 Claims, 5 Drawing Sheets

(56) References Cited

U.S. PATENT DOCUMENTS

| | | | | |
|---|---|---|---|---|
| 2011/0232915 | A1 | 9/2011 | Kellner et al. | |
| 2012/0043073 | A1 | 2/2012 | Bishop et al. | |
| 2013/0161017 | A1 | 6/2013 | King | |
| 2014/0158368 | A1* | 6/2014 | Hofman | E21B 34/14 166/373 |

* cited by examiner

SHIFTING SLEEVES WITH MECHANICAL LOCKOUT FEATURES

CROSS-REFERENCE TO RELATED APPLICATIONS

This is a U.S. national phase under 35 U.S.C. 371 of International Patent Application No. PCT/US2014/013741, titled "Shifting Sleeves with Mechanical Lockout Features" and filed Jan. 30, 2014, the entirety of which is incorporated herein by reference.

TECHNICAL FIELD

The present disclosure relates generally to devices for use in a wellbore in a subterranean formation and, more particularly (although not necessarily exclusively), to devices designed to lock shifting sleeves.

BACKGROUND

Various devices can be utilized in a well traversing a hydrocarbon-bearing subterranean formation. Many such devices are configured to be actuated, installed, or removed by a force applied to the device while disposed in the well. For example, sleeves may be installed in a completion string. Various service tools may be run down the completion in order to activate, move, or shift the sleeve. Currently, when completion or tubing string sleeves are moved or shifted, they are maintained in place with a collet, but they are generally not locked in place. In multi zone wells, service tools are often moved up and down the well. Although a collet may snap to hold the sleeve, the sleeves may still be susceptible to being bumped or dislodged by service tools in the completion string.

DETAILED DESCRIPTION

Figure 1:
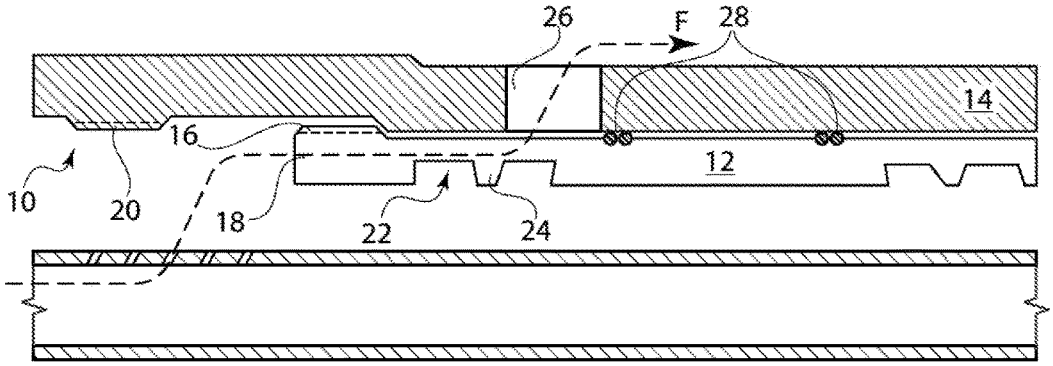
FIG. 1 is a side cross-sectional view of one embodiment of a mechanical locking feature for a shifting sleeve in an open position.

Certain aspects and examples of the present disclosure are directed to shifting sleeves with a mechanical lockout features. The mechanical lockout features will ensure that the shifting sleeves are locked into place with respect to the completion once use has been complete. In some instances, it is desirable to use a sleeve in a downhole wellbore in order to deliver or convey a fluid or other material downhole. In one example, a sleeve may be used to convey proppant at the end of a gravel pack, through the completion string. In another example, a sleeve may be used to deliver fluid from a service tool through an opening in the sleeve and through a housing. Once the fluid has been delivered, the sleeve may be shifted to close the opening and prevent further fluid flow so that the well can be put on production. Sleeves may be used to provide a shifting function to move other tools in the completion. Any other number of uses are possible as well.

However, once used, it may be desirable to leave the sleeve in place in the completion, but to close and lock the sleeve to prevent further flow. The sleeve is left in place in the event that its further use is needed. For example, the sleeve may need to have the ability to open and close freely during well operations (such as during completion, workover, and so forth). The sleeve may need to be available to re-open if desired, but may need to be at least temporarily, but reliably, closed at other times. This issue can be more prevalent in a multi-zone well, where a service tool moves up and down the well. It is possible that a service tool could accidentally re-open an unlocked sleeve. In this instance, it is generally desirable to shift the sleeve to a closed position and lock the sleeve in that position. Accordingly, there is provided a shifting sleeve that has a closed position, as well as a locked position. For opening and closing the sleeve during well operations, the sleeve can be shifted using a profiled shifting tool.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "above," "below," "upper," "lower," "upward," "downward," "left," "right," "uphole," "downhole," etc. in relation to the illustrative aspects as they are depicted in the figures, the upward direction being toward the top of the corresponding figure and the downward direction being toward the bottom of the corresponding figure, the uphole direction being toward the surface of the well and the downhole direction being toward the toe of the well. Like the illustrative aspects, the numerals and directional descriptions included in the following sections should not be used to limit the present disclosure.

Figure 2:
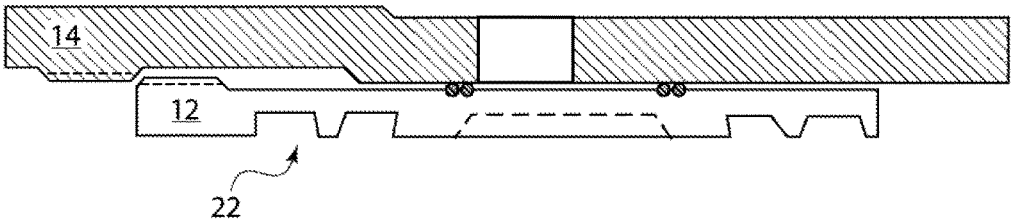
FIG. 2 is a side cross-sectional view of the mechanical locking feature of FIG. 1 in a closed position.
Figure 3:
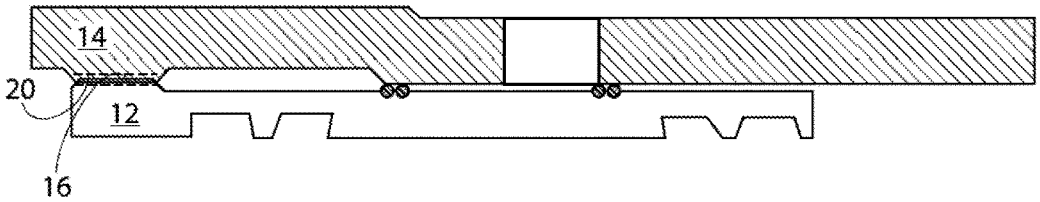
FIG. 3 is a side cross-sectional view of the mechanical locking feature of FIG. 1 in a locked position.

FIGS. 1-3 show one aspect of a shifting sleeve locking system 10. FIG. 1 shows a shifting sleeve 12 positioned with respect to a housing 14. The shifting sleeve 12 has a threaded profile 16 on its outer diameter at one end 18. The threaded profile 16 may extend only a short distance around the end 18. For example, the threaded profile 16 may be only two to six or more threads. The threaded profile 16 may extend a short percentage of the entire length of the sleeve 12, as long as it is sufficient to lock the sleeve 12 in place as discussed. The threaded profile 16 of the sleeve 12 may engage a corresponding threaded profile 20 on the inner diameter of the housing 14. (These figures show only a portion of the completion string wall. It should be understood that the sleeves and housing are generally tubular in nature, such that they extend down a wellbore.)

The sleeve 12 also has a shifting profile 22. Shifting profile 22 includes a shifting key or tool cooperating element 24. This element 24 is shown as a protrusion in a valley, but it may be any appropriate element 24 that can allow a shifting tool to engage and move the shifting sleeve 12.

The outer diameter of the sleeve 12 (or the inner diameter of the housing 14) has one or more optional o-rings 28 shown in FIGS. 1-3. In one aspect, these o-rings prevent flow of any fluid that may be between the sleeve 12 and the housing 14 from extending past an area bordered by the one or more optional o-rings 28.

FIG. 1 shows the shifting sleeve 12 in the open position. In this position, the sleeve 12 allows access to an opening 26 in the housing 14. When the operator is ready to place the sleeve 12 in the locked position, a specially-profiled shifting key or tool may be placed into the shifting profile 22. The tool is configured with a key to latch into the sleeve to move and rotate the sleeve 12. The tool may initially move or shift the shifting sleeve to the closed position, as shown in FIG. 2. For example, an upward motion may cause the key of the service tool to cooperate against profile 22, such that upward motion applied to the service tool translates to the sleeve 12 in order to pull the sleeve 12 upward as well.

In one aspect, a rotational motion may be used in connection with or in addition to the upward motion. The rotational motion or torque is what causes locking of the sleeve 12, as shown in FIG. 3. In order to achieve the locked position, the transmission of torque is applied through the sleeve 12. Torque transmission may be achieved a multiple ways. For example, torque may be transmitted through the service string/work string/coiled tubing through a downhole power unit ("DPU"). For another example, torque may be transmitted through the service string/work string/coiled tubing mechanically with the service tool. As another example, torque may be transmitted through the service string/work string/coiled tubing through a hydraulic pumping mechanism that induces rotation into the shifting key, which transfers rotation to the sleeve 12. The torque causes the threaded profile 16 of the shifting sleeve 12 to thread into the threaded profile 20 of the housing 14, placing the sleeve 12 in the locked position. The shifting key may break free from the shifting profile 22 at a specified torque, ensuring that the shifting sleeve 12 is locked in place. In another aspect, the DPU could be set to disengage at a predetermined time or at a predetermined load. To unlock the sleeve 12, the torque may be applied in an opposite direction.

The torque is not applied to the entire completion, only to the sleeve 12. The sleeve 12 is independent of the other completion components, so torque applied to the sleeve does not translate torque to the completion. Well operators have traditionally been hesitant to rotate tools or any other components downhole, but with deeper completions, there is less certainty about whether a sleeve has been left open or has been bumped open. Additionally, operators are less tolerant of re-working completions, so more certainty as to the position of downhole sleeves is necessary.

Figure 4:
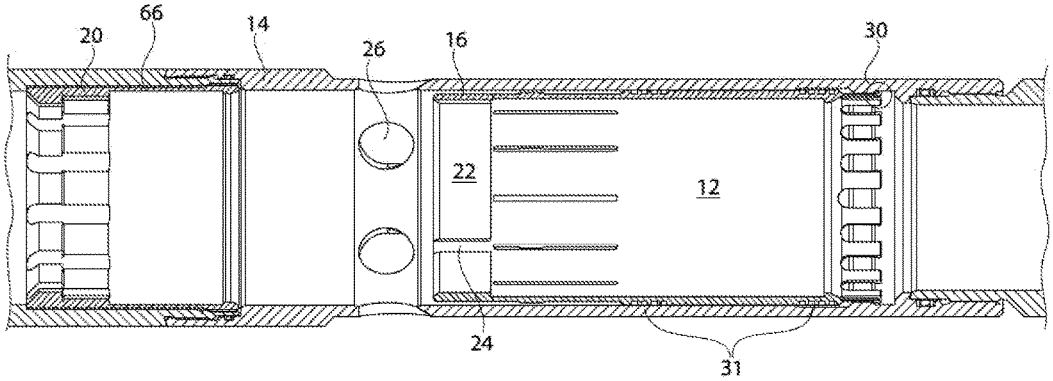
FIG. 4 is a side perspective view of a mechanical locking feature for a shifting sleeve that is positioned away from openings in the housing, with the sleeve in an open position.
Figure 5:
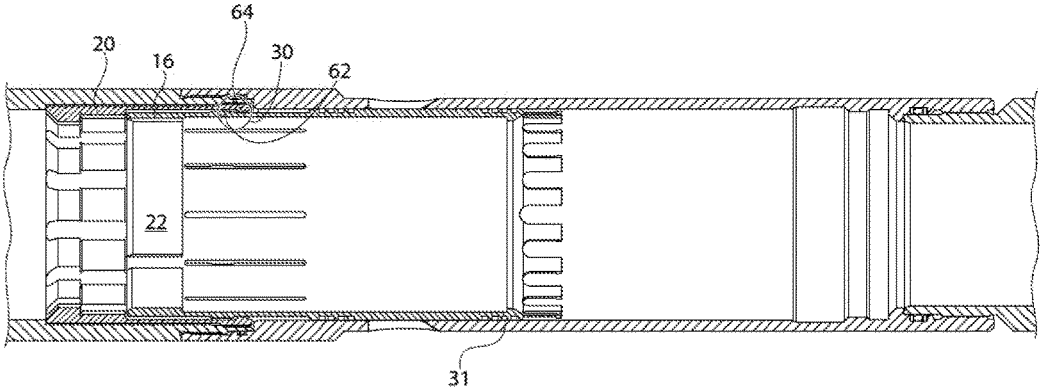
FIG. 5 is a side view of the mechanical locking feature of FIG. 4 in a closed position.
Figure 6:
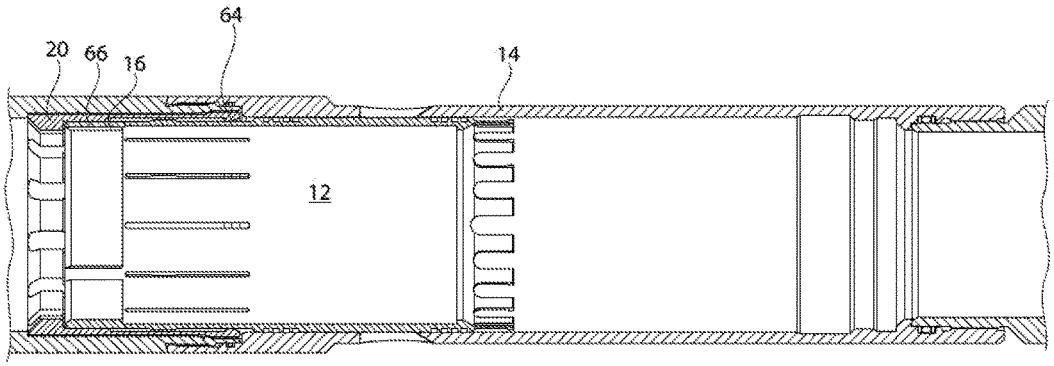
FIG. 6 is a side view of the mechanical locking feature of FIG. 4 in a locked position.

FIGS. 4-6 show an alternate shifting sleeve 12 that is positioned with respect to a housing 14 and a receiving portion 66. The shifting sleeve 12 has similar elements as those described above, for example, the threaded profile 16 that functions as a locking thread. The shifting sleeve 12 is also shown as having a collet profile 30 that keeps the shifting sleeve 12 in the open position, as well as a series of one or more o-ring seals 31. The sleeve 12 also has a shifting profile 22 with a shifting key or tool cooperating element 24 that can allow a shifting tool to engage and move the shifting sleeve 12. When the sleeve 12 is engaged, pulled, and rotated, the threaded profile 16 of the sleeve 12 may engage a corresponding threaded profile 20 on the inner diameter of the receiving portion 66.

FIG. 1 shows the shifting sleeve 12 in the open position. In this position, the sleeve 12 is positioned downhole of the openings 26 in the housing 14. This embodiment can be useful for systems that pump erosive materials. Locating the sleeve 12 downhole of the openings 26 can prevent contact between the fluids and the sleeve 12. This can protect the integrity of the sleeve and avoid unnecessary contact with the fluids.

When the operator is ready to place the sleeve 12 in the locked position, a shifting key or tool may be placed into the shifting profile 22. The tool is configured with a key to latch into the sleeve to move and/or rotate the sleeve 12. The tool may initially move or shift the shifting sleeve to the closed position, as shown in FIG. 5. For example, an upward motion may cause the key of the service tool to cooperate against profile 22, such that upward motion applied to the service tool translates to the sleeve 12 in order to pull the sleeve 12 upward as well.

The closed position of FIG. 5 shows a second collet profile 60 that helps keep the sleeve 12 in the closed position. The collet profile 60 features a shoulder 62 on the sleeve 12 and a corresponding shoulder 64 on the receiving portion 66. The sleeve shoulder 62 abuts the receiving portion should 64 such that lateral or upward movement of the shifting sleeve 12 is stopped. A rotational motion may be used in connection with or in addition to the upward motion. The rotational motion or torque is what causes locking of the sleeve 12, as shown in FIG. 6.

In order to achieve the locked position, the transmission of torque is applied through the sleeve 12. Torque transmission may be achieved in any of the above-described ways. Torque causes the threaded profile 16 of the shifting sleeve 12 to thread into the threaded profile 20 of the receiving portion 66, placing the sleeve 12 in the locked position. To unlock the sleeve 12, the torque may be applied in an opposite direction.

Figure 7:
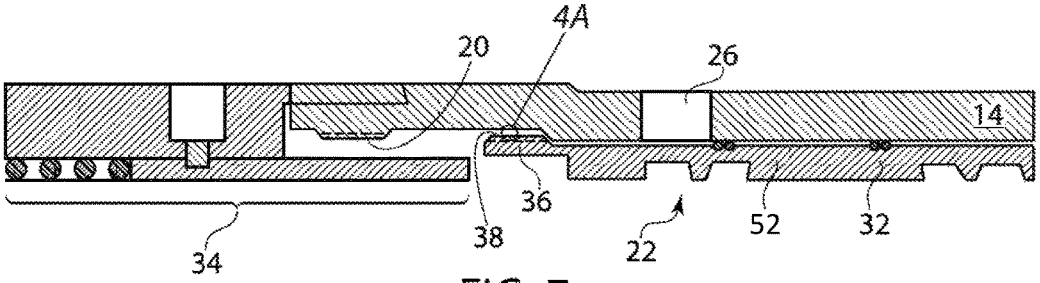
FIG. 7 is a side cross-sectional view of an alternate embodiment of a mechanical locking feature for a shifting sleeve in an open position.
Figure 7A:
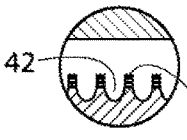
Figure 8:
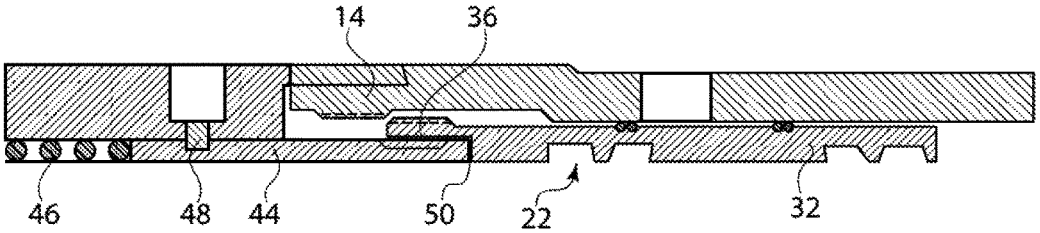
FIG. 8 is a side cross-sectional view of the mechanical locking feature of FIG. 7 in a closed position.
Figure 9:
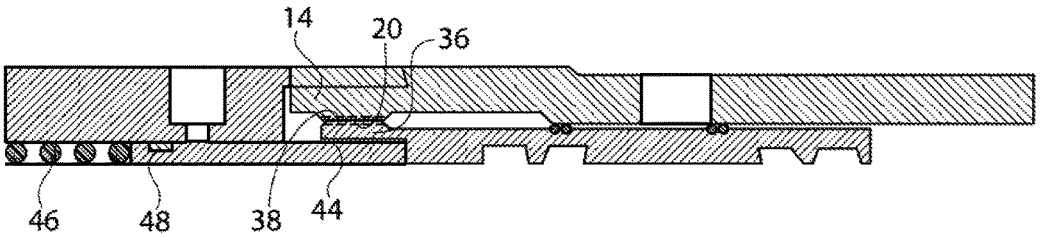
FIG. 9 is a side cross-sectional view of the mechanical locking feature of FIG. 7 in a locked position.

In another aspect, an alternate sleeve 32 with an alternate lockout mechanism may be provided. Examples of this sleeve are shown in FIGS. 7-9. This alternate lockout mechanism may be provided by cooperation between a shifting sleeve 32 and a locking sleeve 34. As shown in FIG. 7, the housing 14 has an opening 26 through which fluid may flow. Once the opening 26 should be blocked, an operator can shift the shifting sleeve 32 and activate the locking sleeve 34 in order to create the desired lock.

In FIG. 7, sleeve 32 is shown as having an extended finger 36 extending from the sleeve body 52. An upper surface of the extended finger 36 may have a textured profile 38 that may cooperate with a corresponding textured outer diameter of the housing 14. In a particular embodiment, the textured outer diameter of the housing is a threaded profile 20. The textured profile 38 of the sleeve 32 may be referred to as a collated thread profile or a "ratchet lock." In one embodiment, the textured profile 38 may resemble threaded tips 40 with U-shaped valleys 42 therebetween. However, it should be understood that other profiles are possible and within the scope of this invention. For example, triangular-shaped ratchet teeth, inwardly and/or outwardly angled teeth (similar to saw teeth), circular drag washers, or any other profile may be provided. Sleeve 32 also has a shifting profile 22, which is shaped to receive a shifting tool, any may have a similar design as described above.

In one embodiment, the locking sleeve 34 may be provided with a locking element 44, a spring 46, and a shear mechanism 48 (such as a pin, ring, screw, or so forth). The locking element 44 may be a locking tube (only an upper cross-section of the configuration is shown) that can move forward and backward within the tubing string based on activation of spring 46. The shear mechanism 48 may extend into an opening on the locking element 44.

As shown in FIGS. 7 and 8, when the sleeve 32 is in the open position, the spring 46 is in its extended/unwound position. The locking element 44 generally abuts the end of spring 46. The shear mechanism 48 maintains the locking element 44 in place. When the operator is ready to place the sleeve 32 in the locked position, the operator places overpull on a shifter or shifting tool. In a specific embodiment, a shifting key or tool may be engaged with or otherwise placed into the shifting profile 22 of sleeve 32. The tool is configured with a key to latch into the sleeve to pull the sleeve. For example, an upward motion may cause the key of the service tool to cooperate against profile 22, such that upward motion applied to the service tool translates to the sleeve 32 in order to pull the sleeve 12 upward as well. An example of this configuration is shown in FIG. 8. FIG. 8 also shows how this movement of the sleeve 32 causes the extended finger 36 to abut the housing 14.

As shown in FIG. 9, continued application of this overpull shears the shear mechanism 48. This shearing pulls or retracts the spring-loaded locking element 44 toward the spring 46, compressing the spring 46. The spring—loaded locking element 44 is now retracted, as shown in FIG. 9. FIG. 9 also shows how retraction of element 44 forces the extended finger 36 between the housing 14 and the locking element 44. The textured or colleted profile 38 of the extended finger 36 interlocks with a profile on housing 14 that is configured to receive and lock against profile 38. In one specific embodiment, this may be a threaded features 20 as described above, or any other feature shape. In one aspect, the corresponding housing profile is a threaded profile 20, such that the same housing 14 may be used with different sleeves 12, 32.

Once the overpull is released, the spring loaded sleeve 44 slides underneath the extended finger 36. In the embodiment shown in FIG. 9, the sleeve 44 and abuts a ledge 50 of the extended finger 36 of the sleeve 32 and locks it into place. The upward/inward pressure and cooperation between the ratchet lock profile 38 and threaded housing profile 20 locks the sleeve 32 into place.

With either of the sleeve options described, it may be necessary to determine that the sleeve 12, 32 has been properly locked. To verify that the shifting sleeve 12, 32 is in the locked position, the shifting tools that would normally open or close the sleeve may be run through the shifting profile 22. If the shifting sleeve is in the locked position, the shifting tool will generally shear out of the profile 22, verifying the locked position. Additionally or alternatively, an open-only shifting tool could be run into the shifting profile 22 and loaded up to a pre-determined force. The inability to re-open the sleeve by conveying a downward force would provide confirmation that the sleeve is locked in the closed and locked position.

This shifting sleeves 12, 32 of this disclosure are particularly useful for multi-zone applications. For example, the shifting sleeves 12, 32 can be selectively locked and unlocked in the event that a particular zone should be re-stressed at a later time. In one aspect, the sleeves 12, 32 could be keyed differently from other sleeves 12, 32 so that different rotating shifter profiles are required to lock/unlock individual shifting sleeves in a multi-zone completion. For example, the shifting profile 22 may be changed on each sleeve to be a custom shape that cooperates only with a corresponding custom shape on a particular shifting tool.

It is also possible to use a combination of sleeves 12, 32 in a single completion, or sleeves of only one type (12 or 32) may be used in a single completion.

The foregoing description, including illustrated aspects and examples, has been presented only for the purpose of illustration and description and is not intended to be exhaustive or to limiting to the precise forms disclosed. Numerous modifications, adaptations, and uses thereof will be apparent to those skilled in the art without departing from the scope of this disclosure.

Claims Bank

The following banked claims are part of the detailed description and are provided for illustrative purposes only.

Banked claim 1. A shifting sleeve system with a mechanical lockout feature, comprising: (a) a shifting sleeve comprising a shifting profile and a locking feature; (b) a housing comprising a corresponding locking feature, wherein application of pressure or torque or both to the shifting profile of the shifting sleeve causes movement of the shifting sleeve and a mechanical lock with the housing.

Banked claim 2. The shifting sleeve system of claim 1, wherein the shifting profile is shaped to cooperate with a shifting tool.

Banked claim 3. The shifting sleeve system of claim 1, wherein the locking feature of the shifting sleeve comprises a threaded end, wherein the corresponding locking feature of the housing comprises a corresponding threaded profile, and wherein the application of torque causes the mechanical lock.

Banked claim 4. The shifting sleeve system of claim 1, further comprising a locking sleeve, the locking sleeve comprising a locking element, a spring, and a shear pin.

Banked claim 5. The shifting sleeve system of claim 4, wherein the locking feature of the shifting sleeve comprises a textured end of the sleeve.

Banked claim 6. The shifting sleeve system of claim 5, wherein the textured end comprises a ratchet lock.

Banked claim 7. The shifting sleeve system of claim 4, wherein application of pressure to the shifting profile causes the shifting sleeve to move into abutment with the locking sleeve, shear the shear pin, and compress the spring, forcing the textured end of the sleeve into cooperation with the corresponding locking feature of the housing.

Banked claim 8. The shifting sleeve system of claim 4, wherein the locking feature of the housing comprises a threaded profile.

Banked claim 9. The shifting sleeve system of claim 1, further comprising one or more sealing rings.

Banked claim 10. The shifting sleeve system of claim 1, wherein the application of torque or pressure comprises mechanical torque transmission through a service string or coiled tubing via a service tool, hydraulic transmission that induces rotation, or a downhole power unit that is set to disengage at a predetermined time or predetermined load.

Banked claim 11. A shifting sleeve system with a mechanical lockout feature, comprising: (a) a shifting sleeve comprising a shifting profile for engagement with a shifting tool and a threaded locking feature; (b) a housing comprising a corresponding threaded locking feature, wherein application of pressure and torque to the shifting profile of the shifting sleeve causes movement and rotation of the shifting sleeve and a mechanical lock between the threaded locking feature of the shifting sleeve and the corresponding threaded locking feature of the housing.

Banked claim 12. The shifting sleeve system of claim 11, wherein the housing comprises one or more openings.

Banked claim 13. The shifting sleeve system of claim 12, wherein the shifting sleeve is positioned downhole of the one or more openings prior to its movement and rotation and wherein the shifting sleeve is moved to close the one or more openings upon its movement and rotation.

Banked claim 14. The shifting sleeve system of claim 12, further comprising a collet profile on the shifting sleeve.

Banked claim 15. The shifting sleeve system of claim 14, wherein the collet profile comprises a shoulder that cooperates with a corresponding shoulder on the housing to stop lateral movement of the shifting sleeve.

Banked claim 16. A method for shifting a sleeve with a mechanical lockout feature, comprising: (a) providing a shifting sleeve system comprising (i) a shifting sleeve comprising a shifting profile and a locking feature; (ii) a housing comprising a corresponding locking feature, (b) applying pressure or torque or both to the shifting profile of the shifting sleeve; (c) causing movement of the shifting sleeve and creating a mechanical lock between the shifting sleeve and the housing.

Banked claim 17. The method of claim 16, wherein the applying pressure or torque of both to the shifting profile of the shifting sleeve comprises rotating the shifting sleeve.

Banked claim 18. The method of claim 16, wherein the application of torque or pressure or both comprises mechanical torque transmission through a service string or coiled tubing via a service tool, hydraulic transmission that induces rotation, or a downhole power unit that is set to disengage at a predetermined time or predetermined load.

What is claimed is:

1. A shifting sleeve system with a mechanical lockout feature, the shifting sleeve system comprising:

a shifting sleeve comprising a shifting profile and a locking feature that are in fixed positions on the shifting sleeve; and a housing coaxially surrounding an entire length of the shifting sleeve and comprising a corresponding locking feature, wherein the locking feature on the shifting sleeve is movable between (i) a locked position in which the locking feature is coupled to the corresponding locking feature of the housing to prevent the shifting sleeve from sliding relative to the housing, and (ii) an unlocked position in which the locking feature is decoupled from the corresponding locking feature of the housing to enable the shifting sleeve to slide relative to the housing; and wherein the shifting sleeve, the shifting profile, and the locking feature are configured to rotate and translate in unison within the housing to cause the locking feature to enter the locked position in response to an application of pressure and torque to the shifting profile of the shifting sleeve.

2. The shifting sleeve system of claim 1, wherein the shifting profile is shaped to cooperate with a shifting tool configured to apply the pressure and torque to the shifting profile of the shifting sleeve.

3. The shifting sleeve system of claim 1, wherein the locking feature of the shifting sleeve comprises a threaded end and the corresponding locking feature of the housing comprises a corresponding threaded profile.

4. The shifting sleeve system of claim 1, further comprising a locking sleeve that includes a locking element, a spring, and a shear pin.

5. The shifting sleeve system of claim 4, wherein the locking feature of the housing comprises a threaded profile.

6. The shifting sleeve system of claim 4, wherein the locking feature of the shifting sleeve comprises a textured end of the shifting sleeve.

7. The shifting sleeve system of claim 6, wherein the textured end comprises a ratchet lock.

8. The shifting sleeve system of claim 6, wherein application of pressure to the shifting profile causes the shifting sleeve to move into abutment with the locking sleeve, shear the shear pin, and compress the spring, forcing the textured end of the shifting sleeve into cooperation with the corresponding locking feature of the housing.

9. The shifting sleeve system of claim 1, further comprising one or more sealing rings.

10. The shifting sleeve system of claim 1, wherein the application of pressure and torque comprises mechanical torque transmission through a service string or coiled tubing via a service tool, hydraulic transmission that induces rotation, or a downhole power unit that is set to disengage at a predetermined time or predetermined load.

11. A shifting sleeve system with a mechanical lockout feature, the shifting sleeve system comprising:

a shifting sleeve comprising a shifting profile for engagement with a shifting tool and a threaded locking feature, the shifting profile and threaded locking feature being in fixed positions on the shifting sleeve; and a housing coaxially surrounding an entire length of the shifting sleeve and comprising a corresponding threaded locking feature, wherein the threaded locking feature on the shifting sleeve is movable between (i) a locked position in which the threaded locking feature is coupled to the corresponding threaded locking feature of the housing to prevent the shifting sleeve from sliding relative to the housing, and (ii) an unlocked position in which the threaded locking feature is decoupled from the corresponding threaded locking feature of the housing to enable the shifting sleeve to slide relative to the housing; and wherein the shifting sleeve, the shifting profile, and the threaded locking feature are configured to rotate and translate in unison within the housing to cause the threaded locking feature to enter the locked position and thereby generate a mechanical lock with the corresponding threaded locking feature of the housing in response to an application of pressure and torque to the shifting profile of the shifting sleeve.

12. The shifting sleeve system of claim 11, wherein the housing comprises one or more openings.

13. The shifting sleeve system of claim 12, wherein the shifting sleeve is configured to (i) enable fluid flow through the one or more openings prior to rotating and translating to generate the mechanical lock, and (ii) prevent fluid flow through the one or more openings after rotating and translating to generate the mechanical lock.

14. The shifting sleeve system of claim 12, further comprising a collet profile on the shifting sleeve.

15. The shifting sleeve system of claim 14, wherein the collet profile comprises a shoulder that cooperates with a corresponding shoulder on the housing to stop lateral movement of the shifting sleeve.

16. A method for shifting a sleeve with a mechanical lockout feature, the method comprising:

providing a shifting sleeve system comprising (i) a shifting sleeve comprising a shifting profile and a locking feature that are in fixed positions on the shifting sleeve; and (ii) a housing coaxially surrounding an entire length of the shifting sleeve and comprising a corresponding locking feature; and applying a first pressure and torque to the shifting profile of the shifting sleeve that causes the shifting sleeve, the shifting profile, and the locking feature to rotate and translate in unison in a first direction within the housing, the rotation and translation within the housing creating a mechanical lock between the shifting sleeve and the corresponding locking feature of the housing such that the shifting sleeve is prevented from sliding relative to the housing; and applying a second pressure and torque to the shifting profile of the shifting sleeve that causes the shifting sleeve, the shifting profile, and the locking feature to rotate and translate in unison in a second direction within the housing, the rotation and translation within the housing disengaging the mechanical lock between the shifting sleeve and the corresponding locking feature of the housing such that the shifting sleeve is slideable relative to the housing.

17. The method of claim 16, wherein the applying the first pressure and torque to the shifting profile of the shifting sleeve comprises rotating the shifting sleeve.

18. The method of claim 16, wherein applying the first pressure and torque comprises mechanical torque transmission through a service string or coiled tubing via a service tool, hydraulic transmission that induces rotation, or a downhole power unit that is set to disengage at a predetermined time or predetermined load.

* * * * *